US007067203B2

(12) United States Patent
Joelsson et al.

(10) Patent No.: US 7,067,203 B2
(45) Date of Patent: Jun. 27, 2006

(54) WEAR RESISTANT COATING WITH ENHANCED TOUGHNESS

(75) Inventors: Torbjörn Joelsson, Linköping (SE); Anders Hörling, Linköping (SE); Lars Hultman, Linköping (SE); Jacob Sjölén, Fagersta (SE); Lennart Karlsson, Fagersta (SE)

(73) Assignee: Seco Tools AB, Fagersta (SE)

( * ) Notice: Subject to any disclaimer, the term of this patent is extended or adjusted under 35 U.S.C. 154(b) by 240 days.

(21) Appl. No.: 10/606,963

(22) Filed: Jun. 27, 2003

(65) Prior Publication Data

US 2004/0105974 A1 Jun. 3, 2004

(30) Foreign Application Priority Data

Jul. 1, 2002 (SE) ..... 0202036

(51) Int. Cl.
*B32B 7/02* (2006.01)

(52) U.S. Cl. ..... 428/697; 51/307; 51/309; 428/336; 428/698; 428/699

(58) Field of Classification Search ..... 51/307, 51/309; 428/336, 697, 698, 699
See application file for complete search history.

(56) References Cited

U.S. PATENT DOCUMENTS 5,208,102 A 5/1993 Schulz et al.
5,330,853 A 7/1994 Hofmann et al.
5,549,975 A 8/1996 Schulz et al.
5,942,455 A 8/1999 Barsoum et al.
6,013,322 A 1/2000 Barsoum et al.

FOREIGN PATENT DOCUMENTS

EP 0 448 720 B1 7/1995

OTHER PUBLICATIONS

W. Jeltschko und H. Nowotny, Die Kristallstruktur von $Ti_3SiC_2$ - ein neuer KOMPLEXCARBID-TYP, Monatsh für Chem. vol. 98 pp. 329-337 (1967).
J. J. Nickl et al., Gasphasenabscheidung Im System TI-Si-C, Journal of the Less-Common Metals vol. 26 pp. 335-353 (1972).
T. Goto et al., Chemically Vapor Deposited $Ti_3SiC_2$, Mat. Res. Bull., vol. 22 pp. 1195-1201 (1987).
T. Seppaänen et al., Structural Characterization of Epitaxial $Ti_3SiC_2$ Films, Proceedings Scandinavian Society for Electron Microscopy Jun. 12-15, 2002, pp. 142-143.
M. W. Barsoum, The $M_{N+1}AX_N$ Phases: A New Class of Solids: Thermodynamically Stable Nanolaminates, Prog. Solid St. Chem. vol. 28 pp. 201-228 (2000).

*Primary Examiner*—Archene Turner
(74) *Attorney, Agent, or Firm*—Drinker Biddle & Reath LLP

(57) ABSTRACT

The present invention relates to a cutting tool insert comprising a substrate and a coating. The coating composed of one or more layers of refractory compounds of which at least one layer comprises a so called MAX-phase defined as $M_{n+1}AX_n$ where n is 1, 2 or 3, M is one of the elements Ti, Zr, Hf, V, Nb, Ta, Cr or Mo, A is Al, Si or S, X is C, N and/or B.

17 Claims, 2 Drawing Sheets

WEAR RESISTANT COATING WITH ENHANCED TOUGHNESS

FIELD OF THE INVENTION

The present invention relates to a cutting tool for machining by chip removal comprising a substrate of cemented carbide, cermet, ceramics, cubic boron nitride based material, high speed steel or the like and a hard and wear resistant refractory coating. The coating can comprise at least one layer of a refractory compound $M_{n+1}AX_n$ where n is 1, 2 or 3, M is one of the elements Ti, Zr, Hf, V, Nb, Ta, Cr or Mo, A is Al, Si or S, X is nitrogen and/or carbon.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

The notation, MAX-phases, is used for a wide range of ceramic materials based on the formula $M_{n+1}AX_n$ wherein M is a transition metal, A is Si, Al, Ge or Ga and X is C, N or B. In the case that X is N only, $M_{n+1}AN_n$, they are referred to as MAN-phases. This family of materials has a hexagonal crystal structure and nanolaminated constitution from large unit cells. The MAX- and MAN-phases are characterized by the low content of non-metallic atoms compared to metallic atoms, i.e.—for n=1; 25 at %, n=2; 33 at % and n=3, 37.5 at %.

The preparation of MAX-phases in form of bulk material of the $Ti_3SiC_2$ phase was first reported in 1967 by Nowotny, Monatsh für Chem. 98:329–337 (1967).

In 1972, Nickl et al, J. Less-Common Metals 26:335 (1972), reported that they have grown $Ti_3SiC_2$ by chemical vapor deposition (CVD) using the reactive gases $SiCl_4$, $TiCl_4$, CC14 and $H_2$. Later also Goto et al., Mat. Res. Bull. 22:1195–1201 (1987), reported growth of $Ti_3SiC_2$ by a CVD process based on the same reactive gases as Nickl et al. at a deposition temperature between 1300 and 1600° C.

The possibility to grow pure phase single-crystal $Ti_3SiC_2$ using PVD technique on single crystal MgO (111) substrates by epitaxial growth have been reported by Seppänen et al (Proc. Scandinavian Electron Microscopy Society, Tampere, Finland, 11–15 June, 2002, s 142–143 ISSN 1455–4518. Three different techniques were reported (i) unbalanced DC magnetron sputtering from elemental targets; (ii) unbalanced magnetron sputtering from elemental target and evaporation of C60; and (iii) unbalanced magnetron sputtering from stoichiometric target.

The anisotropic hardness of the MAX phase $Ti_3SiC_2$ single crystals where first reported by Nickl et al, J. Less-Common Metals 26:283 (1972).

A review of mechanical properties of MAX-phases is made by M. W. Barsoum, Solid St. Chem., Vol. 28 (2000) 201–281. Several unusual properties that are beneficial for applications of ceramics were reported for the $Ti_3SiC_2$ bulk material including high toughness, high flexural strength, crack growth resistance, cyclic crack growth resistance, etc.

U.S. Pat. No. 5,942,455 discloses a process to produce bulk products having single phases or solid solutions of the formula $M_3X_1Z_2$ wherein M is a transition metal, X is Si, Al or Ge and Z is B, C or N by taking a powdered mixture containing M, X and Z to a temperature of about 1000° C. to about 1800° C. The products so formed have excellent shock resistance, oxidation resistance and machinability.

U.S. Pat. No. 6,013,322 discloses a surface treatment by contacting the surface of a "312-compound" (e.g.—$Ti_3SiC_2$) ternary ceramic material with a surface-modifying compound selected from carburization agents, silicidation agents, nitridation agents and boronization agents, at an elevated temperature of at least about 600° C. for a period of time sufficient to provide a surface reaction layer of at least about one micron in thickness in the surface-treated material.

In the system of Ti/Al and other transition metal nitrides, carbides and oxides many patents occur, e.g.—for single layers, e.g.—U.S. Pat. No. 5,549,975, multi-layers, e.g.—U.S. Pat. No. 5,330,853, gradients, e.g.—EP 448,720, or combinations thereof, e.g.—U.S. Pat. No. 5,208,102. However, all those materials are close to stoichiometry between the metallic and non-metallic elements of the NaCl-type cubic phase, i.e. ~50 at %.

SUMMARY OF THE INVENTION

The present invention provides a MAX-coated cemented carbide cutting tool insert for machining by chip removal.

The present invention also provides a method for depositing MAX-layers with high toughness using PVD-technique.

According to another aspect, the present invention provides a cutting tool insert comprising a substrate and a coating, the coating comprising one or more layers of refractory compounds of which at least one layer comprises a MAX-phase defined as $M_{n+1}AX_n$ where n is 1, 2 or 3, M is one of the elements Ti, Zr, Hf, V, Nb, Ta, Cr or Mo, A is Al, Si or S, and X is C, N and/or B.

DETAILED DESCRIPTION OF THE INVENTION

Figure 1:
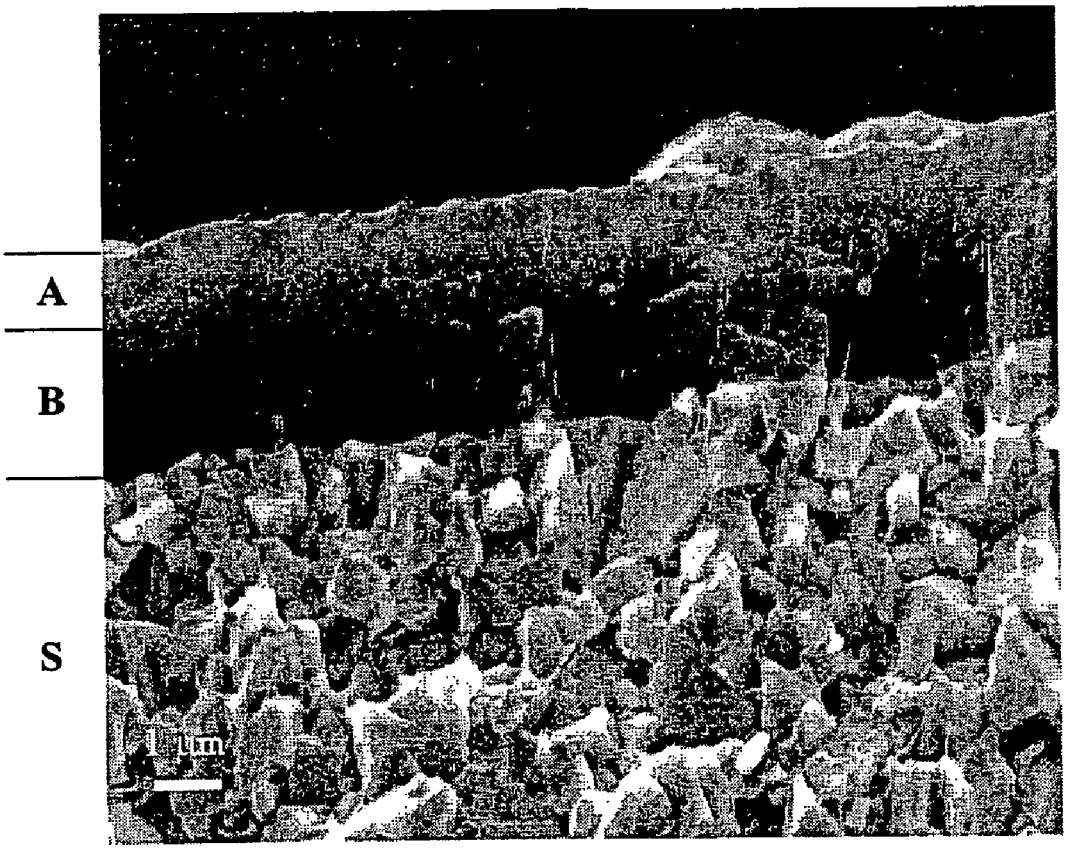
FIG. 1 is a Scanning Electron microscope (SEM) image at 6000× magnification of a coated cutting tool insert according to the present invention.

According to the present invention there is provided a cutting tool for machining by chip removal comprising a body of a hard alloy of cemented carbide, cement, ceramics, cubic boron nitride based material or high speed steel onto which a wear resistant coating is composed of one or more layers of refractory compounds comprising at least one layer of a crystalline MAX-phase.

The coating is composed of one or more layers of refractory compounds of which at least one layer comprises a so called MAX-phase defined as $M_{n+1}AX_n$ where n is 1, 2 or 3, M is one of the elements Ti, Zr, Hf, V, Nb, Ta, Cr or Mo, preferably Ti, A is Al, Si or S, preferably Al, X is C, N and/or B, preferably at least 40 at % N, more preferably $(N_{1-x},C_x)$ where x is between 0 and 0.6, most preferably N. The crystalline MAX-layer is deposited directly onto the cutting tool substrate but there can also be further layers between the tool body and the MAX-layer and/or on top of the MAX-layer composed of metal nitrides and/or carbides and/or oxides with the metal elements chosen from Ti, Zr, Hf, V, Nb, Ta, Cr, Mo, W, Si and Al. Preferably the MAX-layer is the outermost layer or the second outermost layer.

The thickness of said MAX-layer is between 0.1 and 20 μm, preferably between 0.5 and 10 μm. The total coating thickness according to the present invention is between 0.5 and 25 μm, preferably between 1 and 15 μm with the thickness of the non-MAN-layer(s) varying between 0.1 and 10 μm.

In an alternative embodiment, the MAX-layer(s) of 0.5 to 20 μm thickness, with or without a first layer according to above described, can an outer layer consisting of a solid low friction material based on $MoS_2$ or a MeC/C, where Me is Cr, W, Ti or Ta can be deposited as an outermost layer of the coating.

In yet an alternative embodiment, the MAX-layers of a thickness between 0.1 and 2 μm are one of 1 to 5 different materials in a multi-layer coating consisting of 2–500 individual layers.

In yet another alternative embodiment, the MAN-layers 0.5 and 20 μm can be deposited on top of a CVD coating which may comprise one or several layer(s) of a crystalline $Al_2O_3$.

In yet another alternative embodiment, MAN-layers are deposited on top of and/or below the MAX-layer.

An exemplary method used to grow a MAX-layer according to the present invention is either based on magnetron sputtering of an alloy or composite target or a combined process utilizing both arc evaporation and magnetron sputtering of a alloy or composite target/cathode under the following conditions which is exemplified by the Ti/Al-system:

Magnetron sputtering of the MAN-layer is performed using the following data:

Magnetron power density: 2–40 W/cm$^2$, preferably 5–15 W/cm$^2$

The atmosphere used is a mixture of Ar and $N_2$. The partial pressure of $N_2$ is in the range of 1–30 mPa, preferably between 2–15 mPa.

Total pressure is in the range of 0.05–2 Pa, preferably between 0.02–1 Pa.

Bias voltage $V_s$: <0 V, preferably between −5 and −100 V

TiAl-targets with a composition depending on the desired phase is used such as: 75 at % Ti+25 at % Al for $Ti_3AlN_2$, 67 at % Ti+33 at % Al for $Ti_2AlN$ or 80 at % Ti+20 at % Al for $Ti_4AlN_3$ are to be used.

The deposition temperature is in the range of 600–1000° C., preferably between 700–900° C.

The MAN-phase is probably obtained due to the very low partial pressures of $N_2$.

Magnetron sputtering of a MAX-layer like $Ti_3AlC_2$ is performed using similar data as for the $Ti_3AlN_2$ but using a pure Ar atmosphere and a second target for sputtering of C.

The present invention has been described with reference to layers consisting of a MAN-phase and arc evaporated (Ti,Al)N-layers. It is obvious that coatings comprising MAX-layers can also be of advantage in combination with layers grown using other technologies as chemical vapor deposition (CVD) and plasma activated chemical vapor deposition (PACVD), as well as in combination with layers of other materials, if any at all, of metal nitrides and/or carbides and/or oxide with the metal elements chosen from Ti, Zr, Hf, V, Nb, Ta, Cr, Mo, W, Si and Al.

Since some of the MAN/MAX-phases also form metal carbonitride compounds, and by using PVD-technique to grow the MAN-layer, it is simple by adding some carbon containing gas to the atmosphere during deposition (e.g.—$C_2H_2$ or $CH_4$), that carbon alloyed MAN-phases can be obtained e.g. when sputtering from a Ti/Al target; $Ti_2Al(N_{1-x}, C_x)$, $Ti_3Al(N_{1-x},C_x)_2$ or $Ti4Al(N_{1-x},C_x)_3$ where x is between 0 and 0.6.

FIG. 1 is an SEM image of an illustrative coating formed according to the present invention. As shown in FIG. 1, S is a substrate, B is a first coating layer of $Ti_{0.33}Al_{0.67}N$ having a thickness of approximately 2 μm, and A is a MAN layer grown under conditions including a $N_2$ pressure of 6.7 mPa and having a thickness of approximately 1 μm.

Figure 2A:
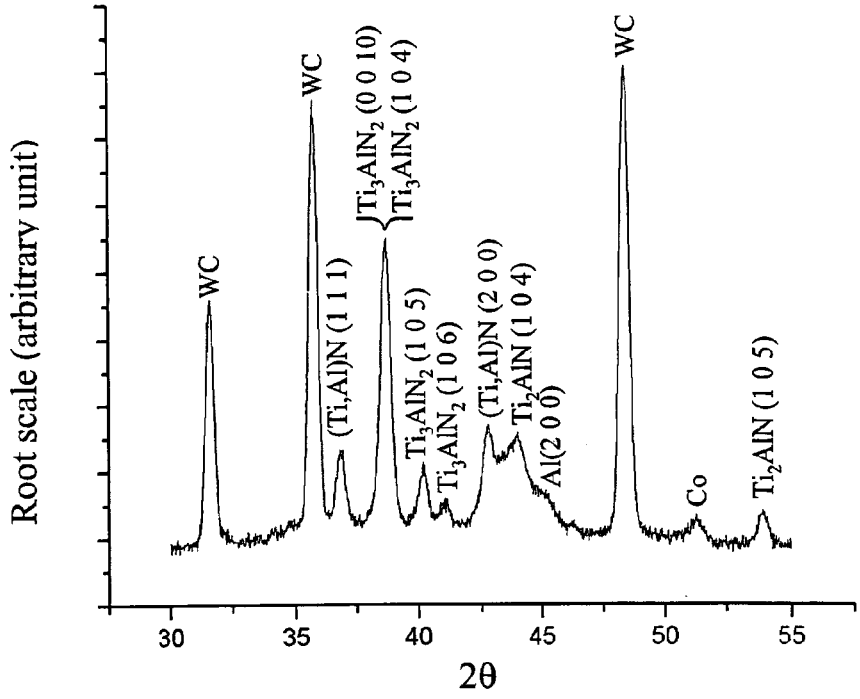
FIG. 2*a* is an X-ray diffraction pattern of the coated insert shown in FIG. 1.
Figure 2B:
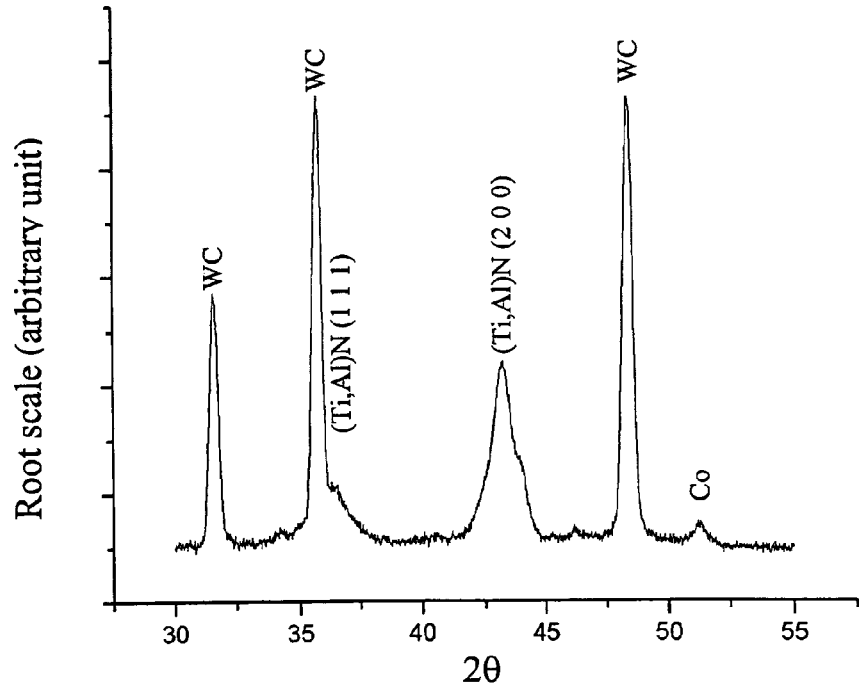
FIG. 2*b* shows the X-ray diffraction pattern of a similar first layer without the top MAN-layer.

MAX/MAN-phases in the coating can be detected by X-ray diffraction (XRD) analysis. In FIG. 2, this is exemplified in the Ti/Al-system showing the MAN-phases $Ti_2AlN$, $Ti_3AlN_2$. By comparing the XRD patterns in FIG. 2*a* ($(Ti_{0.33}Al_{0.67})N$ first layer and MAN-layer) with FIG. 2*b* (only the first layer of FIG. 2*a*; the $(Ti_{0.33}Al_{0.67})N$ layer). A number of new peaks appear when the MAN-layer has been applied, see e.g. between 37.5 to 41.5° 2θ (using CuKa radiation) corresponding to a lattice spacing of 0.217 to 0.240 nm. That those peaks do not correspond to a NaCl-structured phase like TiN and (Ti,Al)N can be determined by examining whether corresponding peaks from (111) or (200) originating from a NaCl-phase, of approximately the same lattice parameter, occurs (small deviations from this can occur due to texture and stress state of the coating).

The present invention will now be described by reference to the following illustrative, non-limiting examples.

EXAMPLE 1

Cemented carbide substrates with composition 6 wt % Co and 94 wt % WC were used. The WC grain size was about 1 μm and the hardness was 1650 $HV_{10}$.

Before deposition, the substrates were cleaned in ultrasonic baths of an alkali solution and alcohol.

A first layer of $(Ti_{0.33}Al_{0.67})N$ was grown using arc evaporation of six Ti/Al (33 at % Ti+67 at % Al) cathodes (63 mm in diameter) in an Ar/N2 atmosphere at total pressure of 2.0 Pa, using a substrate bias of −130 V. The deposition was carried out during 40 min in order to obtain a coating thickness of approximately 2 μm. The deposition temperature was ~550° C.

MAN-layers were deposited on top of the $(Ti_{0.33}Al_{0.67})N$ layer in a commercially available deposition system aimed for thin film deposition equipped with a dc magnetron sputter source with a 75 at % Ti+25 at % Al target (diameter 63 mm).

During the magnetron sputtering of the MAN-layer the substrates were stationarily positioned 30 cm from the magnetron and radiation heated for 60 min. to about 870° C., measured with a thermocouple attached to the substrate holder. Immediately after heating, the substrates were argon-ion etched for 10 minutes using a substrate bias of −1000 V. The subsequent MAN-phase deposition was carried out at the following three different nitrogen partial pressures, PN2; 12.0, 6.7 and 5.3 mPa with a balance of Ar at a constant total pressure of 0.5 Pa. A substrate bias of $V_s$; −25V, a magnetron power of 450 W, (constant current of 0.65 A), resulting in a target potential of about 670 V and were maintained constant during deposition of all layers. The deposition process proceeded for 30 min resulting in a MAN-layer thickness of ~1 μm.

XRD analysis (see FIG. 2) showed peaks originating from the WC phase of substrate, together with peaks from the cubic $(Ti_{0.33}Al_{0.67})N$ layer. However, a large number of additional peaks can also be seen from the hexagonal MAN-phases indexed as $Ti_2AlN$ and $Ti_3AlN_2$, see, —e.g. between 37.5 to 41.5° 2θ for $Ti_3AlN_2$ and at 54° 2θ of $Ti_2AlN$. The film grown with the highest $PN_2$ (12.0 mPa) also exhibited a small peak probably from the cubic $Ti_3AlN$ to be found at 22° 2θ CuKA rαdiation. The peak corresponding to (104) and (00 10) directions of $Ti_3AlN_2$ are strong for both layers grown with the lowest $PN_2$ (see Table 1). The layer grown with the highest $PN_2$ shows only a smaller peak for those direction but instead a strong peak for the (105) direction of $Ti_3AlN_2$. A small peak from the (106) of $Ti_3AlN_2$ direction can only be found for the film grown with the intermediate $P_{N2}$. All films have a small peak corresponding to the (106) direction of $Ti_2AlN$.

SEM studies of fracture cross-sections revealed columnar structure for all layers deposited, no significant contrast and morphology difference between the cubic (Ti,Al)N and the hexagonal MAN-layers could easily be seen. However, in higher magnification, a columnar morphology of the MAN-layer grown using $P_{N2}$=6.7 mPa could be seen (see FIG. 1). The grain size of the MAN-layer is less than 1 μm.

From a scratch test it was concluded that the adhesion was good for all layers. There was no significant difference in critical load $F_{N,C}$ among the layers deposited with different $P_{N2}$ values. They were all in the 40–50 N range. However, the deformation mode is different between the layers consisting of a hexagonal purely MAN-top-layer and the one with small quantity of a cubic $Ti_3AlN$ ($P_{N2}$=12 mPa). The initial failure for the top layer of all pure MAN-layer containing coatings was plastically deformed without spalling, while for the coatings with some cubic $Ti_3AlN$ also some small cohesive fractures occur. If the scratches of the MAN-layers containing coatings are compared with scratch from a coating without the top-MAN-layer a clear difference can be seen showing a large number of cohesive failures around the scratches of the latter. Thus, the scratch test demonstrate that coatings according to present invention comprising a MAN containing layer have strongly enhanced toughness properties compared with coatings grown without.

TABLE 1

The peak height in cps (counts per second) above background for different MAN peaks.

| Variant | $P_{N2}$ [mPa] | Peak height [cps] MAN "312" (104) + (00 10) | Peak height [cps] MAN "312" (105) | Peak height [cps] MAN "312" (106) | Peak height [cps] MAN "211" (106) |
|---|---|---|---|---|---|
| A | 5.3 | 4930 | 310 | — | 85 |
| B | 6.7 | 2940 | 290 | 120 | 138 |
| C | 12.0 | 420 | 1130 | — | 220 |

EXAMPLE 2

Cemented carbide cutting tool inserts, SNGN120408 (WC-6 wt % Co, were coated with a 2 μm thick $(Ti_{0.33}Al_{0.67})N$ as a first layer and a 1 μm thick MAN-layer according to example 1 variant B. As a reference an insert of similar geometry and substrate, coated with a single layer, similar to the first layer of the MAN coated variant, hereafter called variant D were used.

A face milling test with interrupted cut was performed in SS2541 (using three 20 mm wide plates separated by 10 mm, mounted as a package), at $v_c$=200 m/min, f=0.1 mm/rev and depth of cut=2.5 mm.

| Variant | Tool life, mm | Failure mode |
|---|---|---|
| B | 2200 | Chipping and flank wear |
| D | 1500 | Chipping |

This test demonstrates the enhanced toughness of the variant with a top MAN-layer compared to a standard coating.

EXAMPLE 3

The variants according to example 2 were tested in a side milling operation of SS2343. This test is designed to put demands on toughness in combination with low tendency of work material to adhere to the insert.

The side milling test were performed in SS2343, using a solid work piece, at $v_c$=200 m/min, f=0.1 mm/rev and depth of cut=2.5 mm.

| Variant | Tool life, mm | Failure mode |
|---|---|---|
| B | 2400 | Chipping and flank wear |
| D | 1200 | Chipping |

This test also demonstrates the enhanced toughness in combination with decreased tendency of chip adherence using a top MAN-layer.

We claim:

1. A cutting tool insert comprising a substrate and a coating, the coating comprising one or more layers of refractory compounds of which at least one layer comprises a MAX-phase defined as $M_{n+1}AX_n$ where n is 1 or 3, M is one of the elements Ti, Zr, Hf, V, Nb, Ta, Cr or Mo, A is Al, Si or S, and X is C, N and/or B.

2. The cutting tool insert according to claim 1, wherein X is at least 40 at % N.

3. The cutting tool insert according to claim 2, wherein M is Ti, A is Al and X is $(N_{1-x}, C_x)$ where x is between 0 and 0.6.

4. The cutting tool insert according to claim 3, wherein X is N.

5. The cutting tool insert according to claim 1, wherein the at least one layer is the outermost or the second outermost layer of the coating.

6. The cutting tool insert according to claim 1, wherein the at least one layer is combined with at least one additional hard wear resistant layer of metal nitrides and/or carbides and/or oxides of metal elements chosen from Ti, Zr, Hf, V, Nb, Ta, Cr, Mo, W, Si and Al.

7. The cutting tool insert according to claim 1, wherein the at least one layer has a thickness of 0.5–20 μm.

8. The cutting tool insert according to claim 7, wherein the thickness is 0.5–10 μm.

9. The cutting tool insert according to claim 1, wherein the at least one layer is deposited with a PVD technique.

10. A cutting tool insert comprising:

a substrate; and a coating, the coating comprising one or more layers of refractory compounds of which at least one layer comprises a MAX-phase defined as $M_{n+1}AX_n$ where n is 1, 2 or 3, M is one of the elements Ti, Zr, Hf, V, Nb, Ta, Cr or Mo, A is Al, Si or S, and X is $(N_{1-x}, C_x)$ where x is between 0 and 0.6.

11. The cutting tool insert according to claim 10, wherein M is Ti and A is Al.

12. The cutting tool insert according to claim 11, wherein X is N.

13. The cutting tool insert according to claim 10, wherein the at least one layer is the outermost or the second outermost layer of the coating.

14. The cutting tool insert according to claim 10, wherein the at least one layer is combined with at least one additional hard wear resistant layer of metal nitrides and/or carbides and/or oxides of metal elements chosen from Ti, Zr, Hf, V, Nb, Ta, Cr, Mo, W, Si and Al.

15. The cutting tool insert according to claim 10, wherein the at least one layer has a thickness of 0.5–20 μm.

16. The cutting tool insert according to claim 15, wherein the thickness is 0.5–10 μm.

17. The cutting tool insert according to claim 10, wherein the at least one layer is deposited with a PVD technique.

* * * * *